US005690151A

United States Patent [19]

Rutter et al.

[11] Patent Number: 5,690,151

[45] Date of Patent: Nov. 25, 1997

[54] DUAL CHANNEL BAG FILLING MACHINE WITH A CLEAN-IN-PLACE SYSTEM THAT CLEANS ONE CHANNEL WHILE THE OTHER CONTINUES TO FILL BAGS

[75] Inventors: Christopher C. Rutter, Oakland; Robert A. Bilbrey, Orinda; William Charron, Fremont, all of Calif.

[73] Assignee: Packaging Systems, Inc., Romeoville, Ill.

[21] Appl. No.: 631,683

[22] Filed: Apr. 2, 1996

[51] Int. Cl.[6] ..... B65B 1/04

[52] U.S. Cl. ..... 141/92; 141/90; 141/114; 222/148; 134/166 R; 134/171

[58] Field of Search ..... 141/89, 90, 91, 141/92, 129, 135, 114; 134/95.1, 95.2, 166 R, 169 R, 171; 222/148

[56] References Cited

U.S. PATENT DOCUMENTS 4,283,901 8/1981 Schieser et al. .
4,417,610 11/1983 Waldstrom et al. ..... 141/91
4,574,559 3/1986 Rutter et al. .
4,620,411 11/1986 Schieser et al. .
4,676,285 6/1987 Schieser et al. .
5,115,626 5/1992 Rutter et al. .
5,129,212 7/1992 Duffy et al. .
5,531,253 7/1996 Nishiyama et al. ..... 141/90

*Primary Examiner*—Henry J. Recla
*Assistant Examiner*—Steven O. Douglas
*Attorney, Agent, or Firm*—Majestic, Parsons, Siebert & Hsue

[57] ABSTRACT

A machine for filling containers, such as flexible plastic bags, with fluid product, such as liquid food product, using two container fill nozzles that each having a product supply system. While one of the nozzles is being used to fill containers that are being moved through the machine, the other nozzle and its product supply system is being cleaned. For the cleaning, at least one receptacle is provided to receive a nozzle being cleaned. Any product remaining in the delivery system and nozzle is flushed out through the receptacle in which the nozzle is inserted, and those portions cleaned. Fresh product is then loaded back into the delivery system and dispensed through the nozzle into the containers. This system and these operating techniques allow the product to be changed frequently without having to suffer a significant down time of the filling machine for cleaning.

12 Claims, 9 Drawing Sheets

DUAL CHANNEL BAG FILLING MACHINE WITH A CLEAN-IN-PLACE SYSTEM THAT CLEANS ONE CHANNEL WHILE THE OTHER CONTINUES TO FILL BAGS

BACKGROUND OF THE INVENTION

This invention relates generally to machinery that automatically loads fluid product, such as liquid food material, into containers, such as flexible plastic bags, and more specifically, to such filling machines that include a system for periodically cleaning the product delivery system and container filling nozzle.

Small, economical containers are used in large volume for the storage, transportation and dispensing of food and other products in liquid or granular form. A commonly used container is a flexible plastic bag that, before filling, is flat, except for the possibility of a plastic spout being attached to a sidewall of the bag to receive and dispense the product from it. A typical filling machine receives a succession of empty bags by some conveying means for filling with product. Examples of such machines are given in U.S. Pat. Nos. 4,574,559, and 5,115,626, the disclosures of which are incorporated herein by this reference.

One type of food product that is commonly shipped and dispensed from such bags is soft drink syrup. Restaurants are large users of such a product, connecting bags of syrup to soft drink dispensing machines until empty and then discarding or recycling them. There are many different types and flavors of syrups that are delivered and used in this way. Since the machines used to fill the bags with product are extremely fast, a large number of bags is filled in a short period of time. As result, it is often necessary to frequently change the flavor of the syrup that is being filled into the bags. It is then usually necessary to thoroughly clean the hoses, pipes and other parts of the machine's product delivery system before loading the machine with a new flavor of syrup. The same cleaning requirement exists for most other products that are loaded into bags and other containers by such machines.

It is a primary object of the present invention to provide a clean-in-place system for such filling machines that allows the cleaning to take place while minimizing, or even eliminating, the time that the machine is out of service due to the product being changed.

It is another primary object of the present invention to provide an improved clean-in-place system and techniques for cleaning such filling machines.

SUMMARY OF THE INVENTION

These and additional objects are accomplished by the present invention, wherein, according to one aspect thereof, two or more container filling nozzles are included in the filling machine, each nozzle being supplied with product by its own delivery system. This allows, therefore, one nozzle and delivery system to continue to be used to fill containers while the other is being cleaned. This minimizes, or even eliminates in most cases, the down time of the filling machine when a cleaning operation is taking place. A nozzle and its delivery system is usually cleaned when the product being dispensed by it is changed, in order to prevent contamination between successive products, but this technique is also useful for conducting periodic cleaning without changing the product. While one nozzle and delivery system is filling containers, the other nozzle and delivery system is being cleaned and refilled with fresh product. At some point, the newly cleaned and refilled nozzle and delivery system is placed into operation to fill containers while the first is subjected to a cleaning cycle.

According to a second aspect of the present invention, the cleaning is conducted substantially automatically, with little or no hand manipulation being necessary, by providing in the machine's filling station one or more receptacles that receives the nozzle being cleaned during a cleaning cycle. A mechanism is then provided to automatically move each nozzle of the filling machine between a first position for filling containers and a second position in which is it inserted into the cleaning receptacle. When the nozzle is positioned in the receptacle, cleaning fluid is passed from its delivery system, through the nozzle and into the receptacle.

According to a third aspect of the present invention, an improved technique is provided for cleaning a delivery system and readying it to dispense fresh product. A cleaning fluid is passed through the delivery system and nozzle, and into the receptacle. The cleaning fluid can be discarded from the receptacle into a drain or recycled into a cleaning fluid tank. Such cleaning fluids include any or all of rinse water, air and a chemical cleaning solution. Once cleaned, fresh product is circulated through the delivery system in a closed loop through the nozzle and receptacle, and then back through a return path to the delivery system again. Prior to commencing filling containers with the newly readied delivery system, new product in the return path may be removed into the delivery system in order to avoid wasting product. The cleaning system and techniques of the present invention may be included in a filling machine having a single nozzle, as well as with a multiple nozzle filling machine.

Additional aspects, objects, features and advantages of the present invention will become apparent from the following description of its preferred embodiments, which description should be taken in conjunction with the accompanying drawings.

DESCRIPTION OF THE PREFERRED EMBODIMENTS

Figure 1:
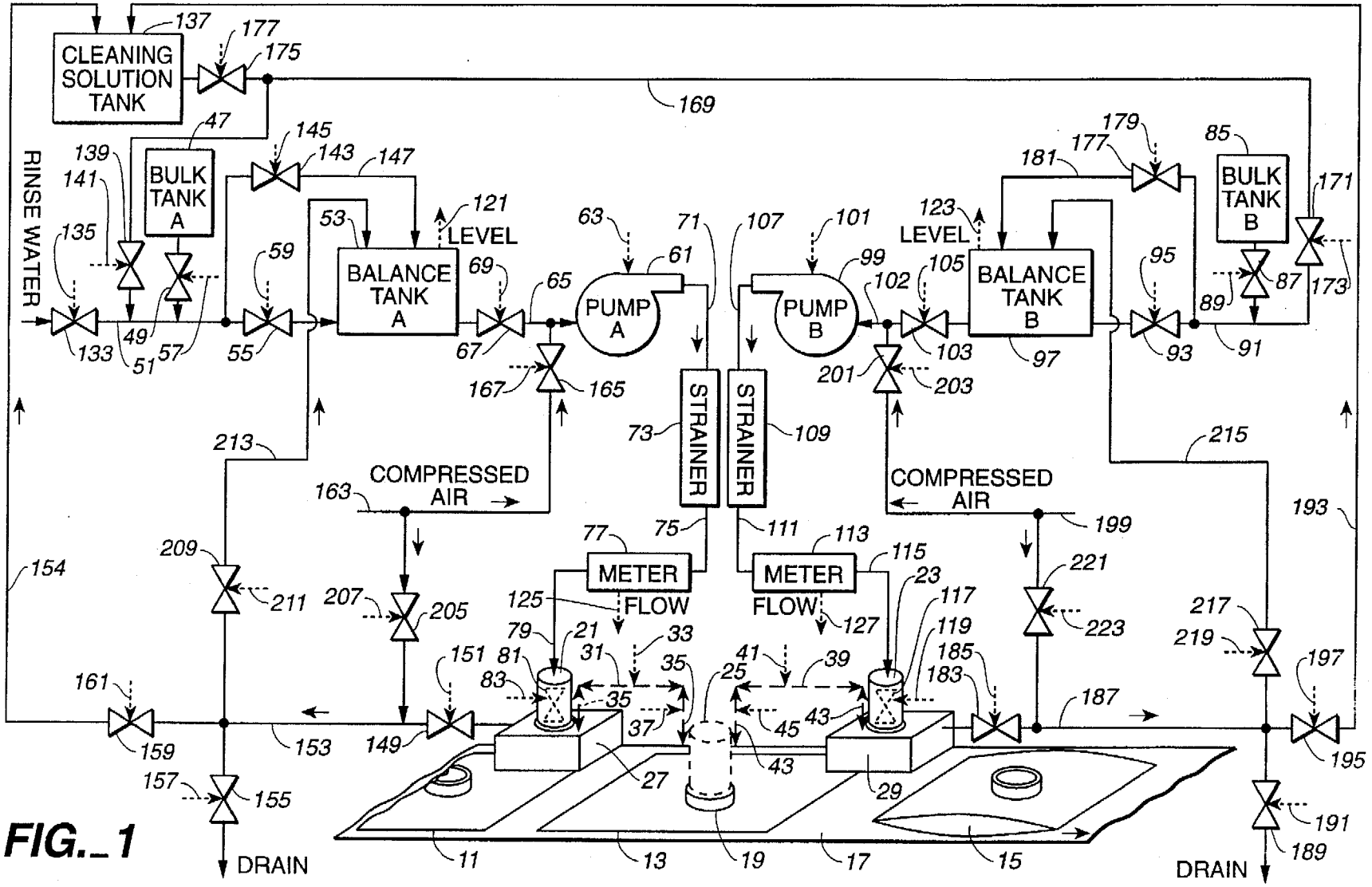
FIG. 1 schematically illustrates a first embodiment of a filling machine that utilizes the various aspects of the present invention.

In the filling machine embodiments schematically illustrated in FIG. 1, containers, such as flexible plastic bags 11, 13 and 15, are moved through the machine's filling station by some type of conveying mechanism 17. The bag 11 is empty and shown to be entering the filling station. The bag 13 is positioned in the filling station at a location to be filled. The bag 15 is shown leaving the filling station after being filled with product. A preferred mechanism for moving bags into and out of the filling station is described in aforementioned U.S. Pat. No. 5,115,626. Although the bag may be filled by a nozzle either puncturing the bag or entering through a slit in the bag, the bags illustrated in FIG. 1 include a plastic spout 19 attached to one side in order to allow both filling of the bag by the machine and dispensing product from the bag by the end user.

The filling machine utilizes two separate filling nozzle assemblies 21 and 23, each of which can be moved, one at a time, into a container filling position 25 that is shown in dotted outline. Further, each of the nozzle assembles 21 and 23 may be moved into one of the receptacles 27 and 29. When positioned in a receptacle, a nozzle establishes a fluid path through the receptacle. The nozzle 21 is moved between the receptacle 27 and the container filling position 25 by horizontal movement 31, imparted by a motive source in response to a control signal 33, and vertical motion 35, imparted by another motive source in response to a control signal 37. Similarly, the nozzle 23 is provided horizontal motion 39 in response to a control signal 41, and vertical motion 43 in response to a control signal 45. These movements of the nozzle are powered by a conventional motive source, such as a electrical servo motor, an air cylinder or the like, as is most convenient and economical for the particular movement desired.

Each of the nozzle assemblies 21 and 23 is provided with a separate product delivery system. For the nozzle 21, a product storage tank 47 provides product through a valve 49 into a fluid path 51, in the form of a pipe, hose or other fluid conduit. Another tank 53 is supplied material from the liquid path 51 through a valve 55. The valves 49 and 55 operate in response to control signals 57 and 59, respectively. The product is then moved out of the tank 53 by a pump 61, controlled by a signal 63, through a fluid path 65 that contains a valve 67 controlled between open and closed positions by a signal 69. An output of the pump passes product through a fluid path 71, a strainer or filter 73, another fluid path 75, and through a flow meter 77 and then into the nozzle assembly 21 through another liquid path 79. The nozzle assembly 21 includes a valve 81 that operates in response to a control signal 83 to open or close the fluid passages in its nozzle.

The nozzle assembly 23 has a delivery system that is substantially identical to that just described for the nozzle assembly 21 but independently operable. A tank 85 is a source of product to be filled in the containers, being dispensed through a valve 87 that is controlled by a signal 89. When the valve 87 is open, the product is dispensed into a fluid path 91 and through a valve 93, when opened by a control signal 95, into another tank 97. The product is then pumped out of the tank 97 by a pump 99, controlled by a signal 101, when a valve 103 is opened by a control signal 105. A fluid path 107 takes the output of the pump 99 through a strainer or filter 109 and then through a fluid path 111 through a flow meter 113. This is followed by the product passing from the flow meter 113 through a fluid path 115 and into the nozzle assembly 23. The nozzle assembly 23 includes a valve 117 operated by a control signal 119 to open and close the nozzle to fluid flow therethrough.

Figure 2:
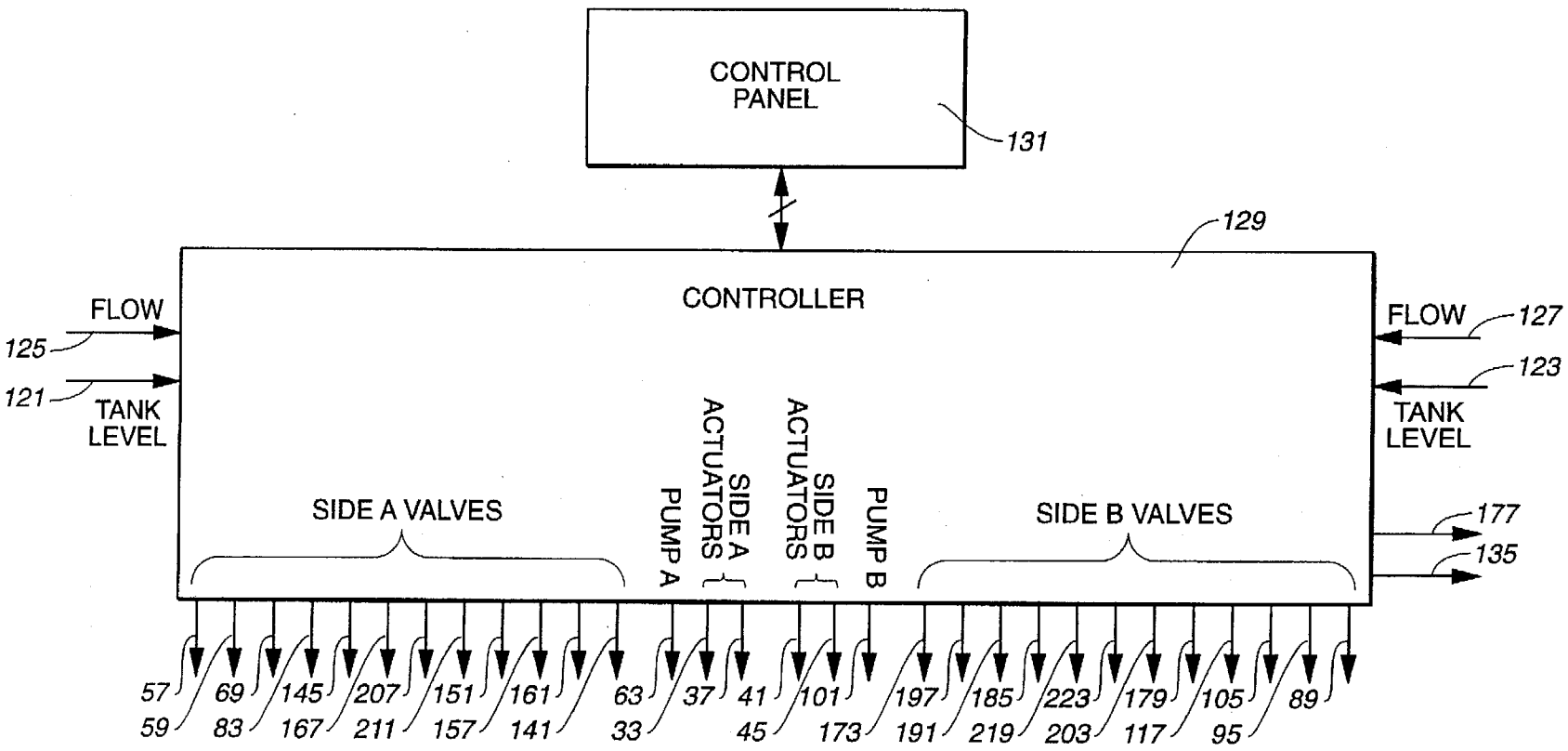
FIG. 2 shows the electronic controller and control lines used to operate the filling machine of FIG. 1.

Each of the product tanks 53 and 97 is open to the atmosphere. The product is maintained within each of these tanks to a controlled level, as communicated by respective level signals 121 and 123. The flow meters 77 and 113 have respective output signals 125 and 127 that give an indication of the amount of liquid that has passed through the respective meters. A machine controller 129, illustrated in FIG. 2, receives some of the signals described with respect to FIG. 1 and provides others. The controller 129 includes the computer that controls the various filling and cleaning operations of the filling machine. A control panel 131 connected to the controller 129 allows an operator to read out certain status and control information, and also input desired commands and information to the controller 129.

In addition to the fluid paths and valving used to supply product to the container filling nozzle, each of the channels of the machine of FIG. 1 includes a system for cleaning the product delivery system. When the product supply valve 49 is closed in one channel, a cleaning fluid may be introduced into the fluid path 51 instead of the product. Two different liquids are available. A first is ordinary water that is connected with the fluid path 51 through a valve 133 that operates in response to a control signal 135. A second liquid is a cleaning solution that comes from a tank 137 through a valve 139 that operates in response to a control signal 141. The cleaning solution stored in the tank 137 is that which can operate to thoroughly remove product from the walls of pipes, tubes, valves, etc., in the product delivery system. Either the rinse water or cleaning solution may be introduced into the tank 51 through the valve 55 or through a valve 143, which operates in response to a control signal 145, and then through a fluid path 147 to a spray nozzle within the tank 53 at its top.

During a cleaning cycle, either or these cleaning fluids are pumped by the pump 61 out of the balance tank 53, through the strainer 73, the flow meter 77 and through the nozzle assembly 21, following the same path that has been used to deliver product to the nozzle so that all of that product is removed and cleaned from the delivery system. The cleaning fluid then enters a receptacle 27, into which the nozzle assembly 21 is inserted in a fluid tight manner. Cleaning fluid then exits the receptacle 27 through a valve 149 that is operated by a control signal 151. The cleaning fluid passes through a fluid path 153 and can be directed in one of two directions. One is to pass the cleaning fluid through a valve 155, controlled by a signal 157, to a drain in order to expel the cleaning fluid from the machine. A second path is through a valve 159, controlled by a signal 161, which passes the expelled cleaning fluid back to the cleaning solution storage tank 137. This latter path will generally be used when the cleaning fluid is the solution from the tank 137, thereby circulating the cleaning solution in a closed loop from the tank, through the product delivery system and back to the tank again. However, when the cleaning fluid is rinse water introduced through the valve 133, the rinse water expelled into the fluid path 153 will usually be expelled to the drain through the valve 155.

A third source of cleaning fluid is compressed air introduced from an air compressor through a fluid path 163. When a valve 165 is opened in response to a control signal 167, air is introduced into the fluid path 65 just ahead of the pump 61. When the valves 149 and 155 are opened, compressed air then passes through the product delivery system and to the drain. Some other gas may be used in place of air, of course, but air is certainly the most convenient and economical to use. This air cleaning generally occurs after cleaning steps utilizing rinse water and/or the cleaning solution have occurred.

Essentially the same cleaning mechanism is provided with the other product delivery channel. Rinse water is supplied through the valve 133, the valve 139, a fluid path 169 and then through a valve 171 that is controlled by a signal 173. When the valve 139 is closed, however and a valve 175 is opened through a control signal 177, cleaning solution from the tank 137 is passed through the fluid path 169 and valve 171 into the delivery system fluid path 91. Either of these cleaning fluids can then be introduced into the product tank 97 through the valve 93 or through another valve 177 control by a signal 179, and into a spray head at the top of the tank 97 through a fluid path 181.

After passing through the product delivery system of the second channel, cleaning fluid exits the receptacle 29 through a valve 183, controlled by a signal 185, and into a fluid path 187. Fluid in the path 187 can either be expelled to a drain through a valve 189, controlled by a signal 191, or passed back to the cleaning solution tank 137 by a path 193 through a valve 195 controlled by a signal 197. Compressed air in a fluid path 199 is introduced into the fluid path 102, just ahead of the pump 99, through a valve 201 that is controlled by a signal 203.

The compressed air is also introduced in each of the channels at a second point. In the supply channel including the valve assembly 21, compressed air may be introduced into the fluid path 153 through a valve 205 that operates in response to a control signal 207. Although this may have some use in the cleaning cycle, it is provided primarily after new product has been introduced into the delivery system and just before it is used to fill containers with the fresh product. A recirculation path for the fresh product is provided through the receptacle 21, the valve 149 and then through another valve 209, operating in response to a control signal 211, and a fluid path 213 back to the tank 53. This recirculation path allows the fresh product to be moved in a closed loop from the pump 61 from the tank, through the valve assembly 21 and back to the tank again. But after this recirculation is accomplished, it is generally desired to clear the part of the recirculation path that is not used to deliver product in order to avoid wasting the product stored in the return fluid path 213 and then to enable its use in a subsequent cycle. The valve 209 and return fluid path 213 can also be cleaned by passing rinse water and/or cleaning solution through it before being used to recirculate new product back to the tank 53.

The second product delivery channel includes a similar recirculation fluid path 215 that returns fluid from the path 187 to the tank 97 through a valve 217, controlled by a signal 219. Compressed air in the path 199 is connected to the fluid path 187 through a valve 221 in response to a control signal 223.

A typical operation of the filling system of FIG. 1 is illustrated in FIGS. 3 and 4. Referring first to FIG. 3A, each of the nozzle assemblies 21 and 23 is positioned within their respective receptacles 27 and 29. In FIG. 3B, the nozzle assembly 21 has been moved off of its receptacle 27 and into a bag filling position as an empty plastic bag 13 approaches the filling station. A cleaning fluid is positioned in the fluid path 115 of the other nozzle assembly 23 but its valve 117 is closed. In a step illustrated in FIG. 3C, the plastic bag 13 is moved so that its spout 19 and nozzle assembly 23 physically mate. At the same time, the valve 117 within the nozzle assembly 23 is opened to allow the cleaning fluid to pass through it and into the receptacle 29. In the next step of FIG. 3D, the valve 81 of the nozzle assembly 21 is opened to permit product to be loaded through it and into the bag 13. The valve 81 is open just long enough to allow the right amount of product to enter the bag 13. This is controlled by the controller 129 (FIG. 2) in response to a signal on line 125 from the flow meter 77 (FIG. 1). At the same time that the bag 13 is being filled, cleaning fluid is passing through the valve assembly 23 and receptacle 29.

Figure 3A:
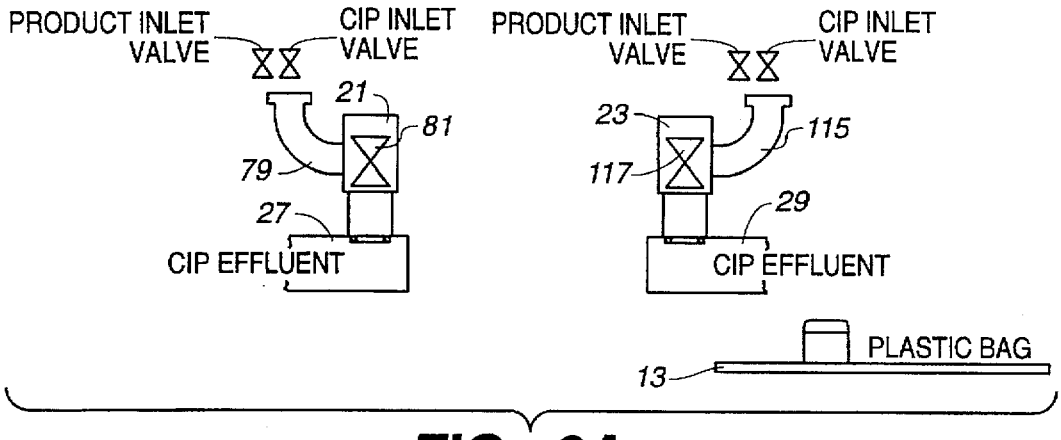
FIGS. 3A–3E illustrate sequential steps in the operation of the filling machine of FIG. 1.
Figure 3B:
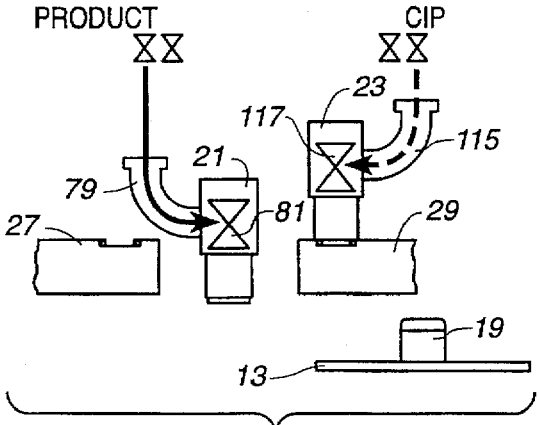
Figure 3C:
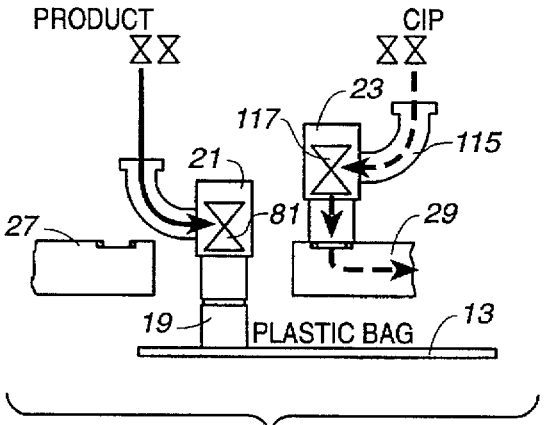
Figure 3D:
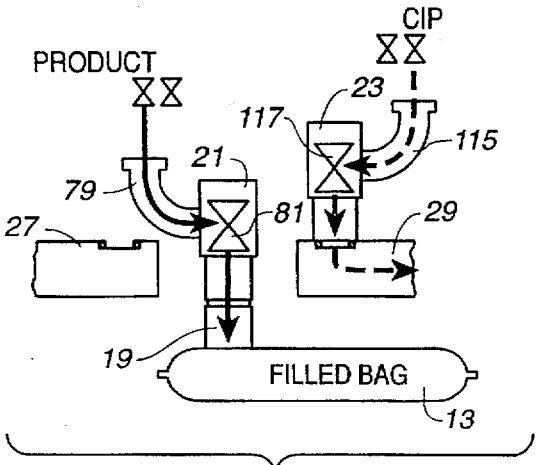
Figure 3E:
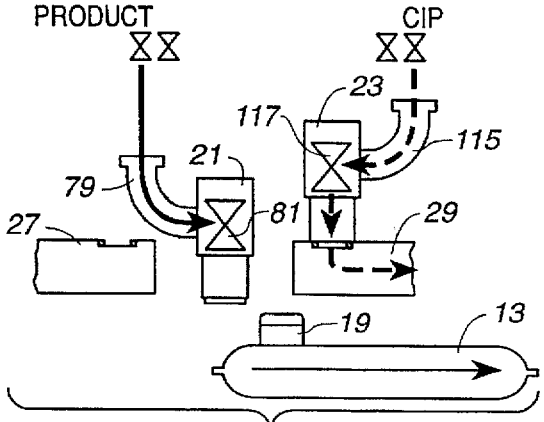

After the bag 13 is filled, as shown in FIG. 3E, the valve 81 has been shut off and the filled bag is moved away from the filling station. Typically, a bag is moved into position, filled and moved out of position in only a few seconds, depending upon the size of the bag. As the bag 13 is moved out of the filling station, a new bag is simultaneously moved into the filling station right behind it.

Figure 4A:
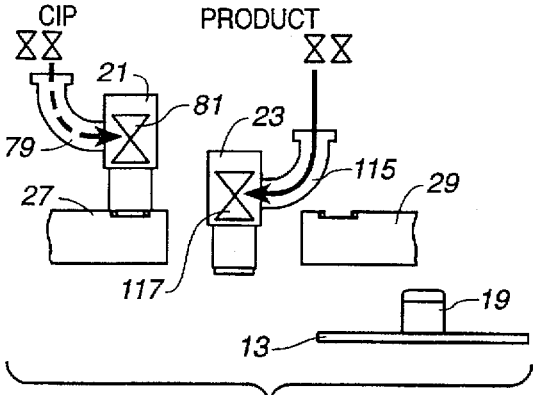
FIGS. 4A–4E show yet another sequence of operations of the filling machine of FIG. 1.
Figure 4B:
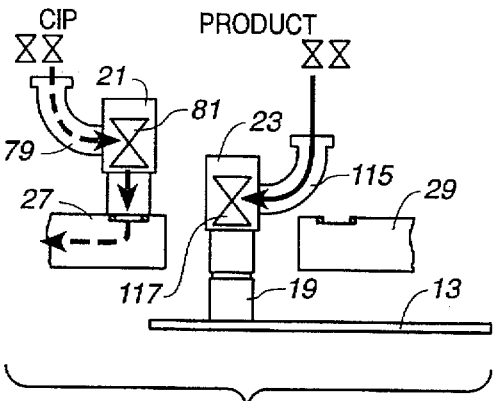
Figure 4C:
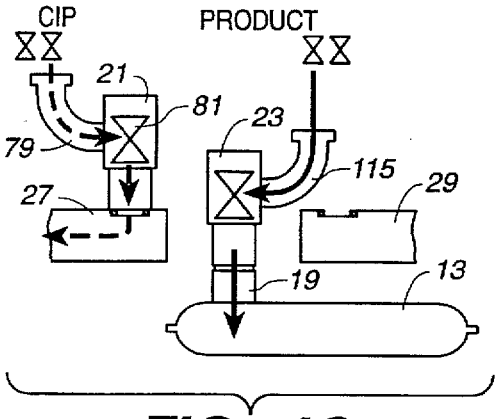
Figure 4D:
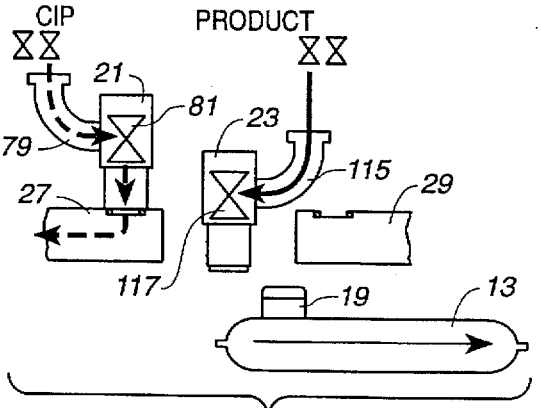
Figure 4E:
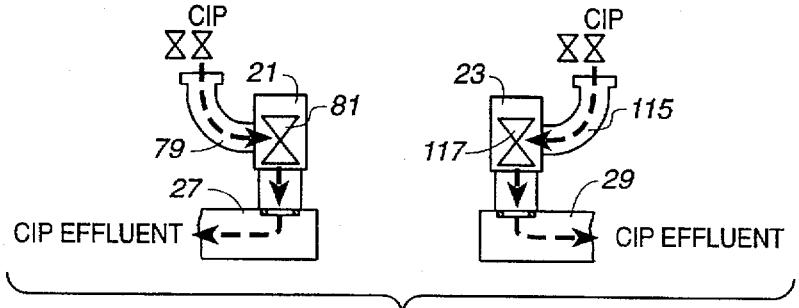

FIGS. 4A–4D show operation of the other channel that supplies product to the valve assembly 23, which correspond, respectively, to FIGS. 3B–3E. While bags are being filled with product through the valve assembly 23, cleaning fluid is being passed through the valve assembly 21 and its receptacle 27. FIG. 4E shows a possibility of both delivery system channels having cleaning fluid pass through them at the same time.

Figure 5:
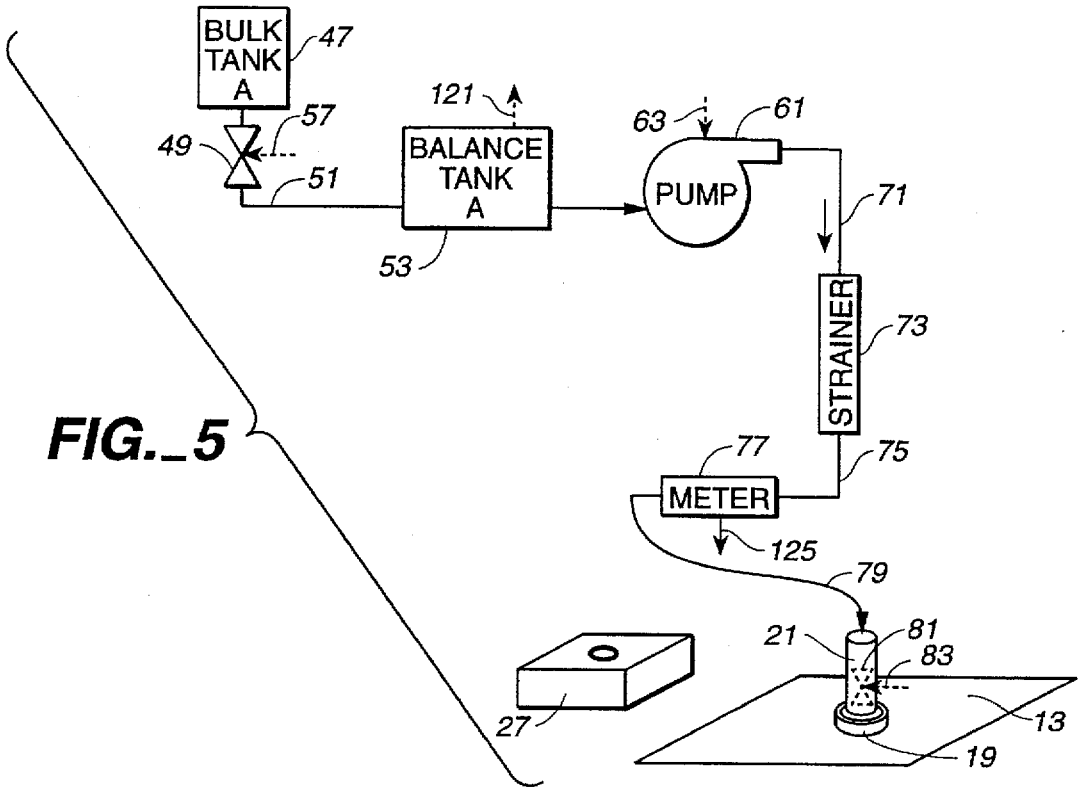
FIG. 5 shows the portions of the filling machine of FIG. 1 that are used for filling containers with product.

Referring to FIG. 5, the elements of one channel of the system of FIG. 1 are shown which contribute to that channel operating to fill bags with product. A liquid level signal 121 of the supply tank 43 is used by the controller 129 (FIG. 2) to open and close the valve 49 through its control signal 57 in order to maintain a substantially uniform level of liquid within the tank 53. In the embodiment being described, product is shown to be delivered from the tank 47 but, of course, product can be supplied in other ways through the valve 57 into the product delivery system for the valve assembly 21. Product is pumped by the pump 61 through the strainer 73, flow meter 77 and into the bag 13 through the nozzle assembly 21 when its valve 81 is opened by a proper signal 83. The controller 129 (FIG. 2) provides the valve control signal 83 in response to a signal 125 from the flow meter 77. The valve 81 is thereby opened for a time to precisely load a certain volume of liquid into the bag 13.

Figure 6:
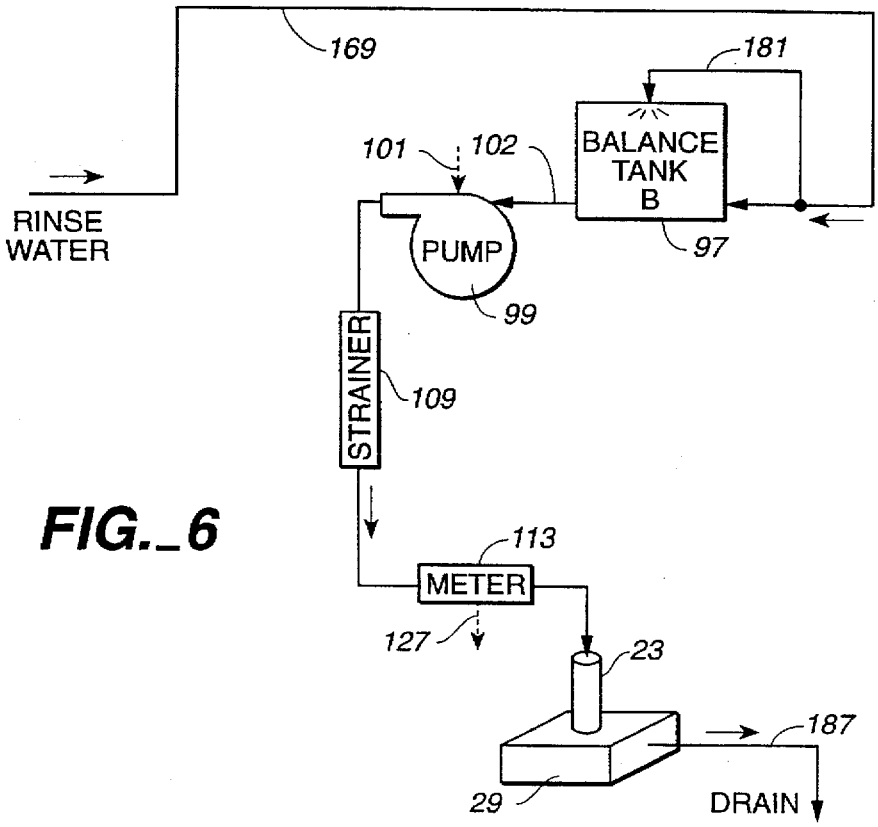
FIG. 6 shows the portions of the filling machine of FIG. 1 that are used to rinse product from a portion of the filling machine of FIG. 1.
Figure 7:
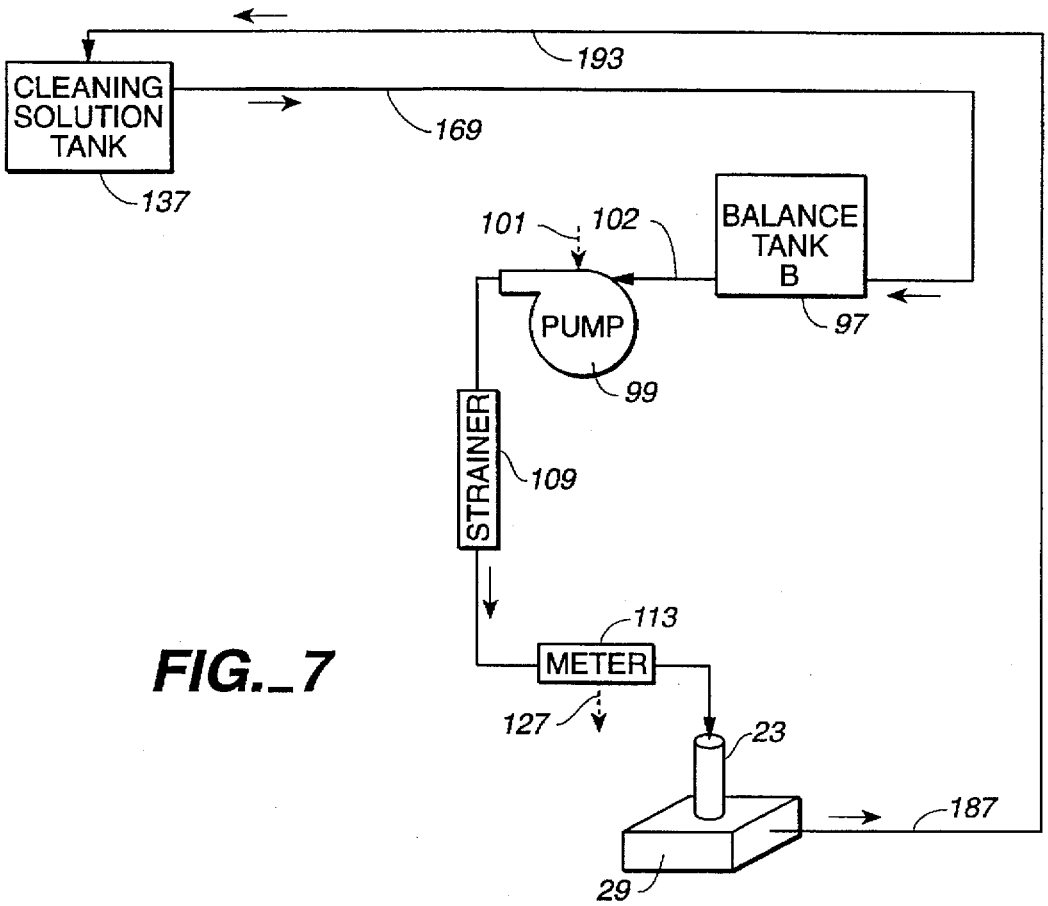
FIG. 7 shows the portions of the filling machine of FIG. 1 that are used to recirculate cleaning solution.
Figure 8:
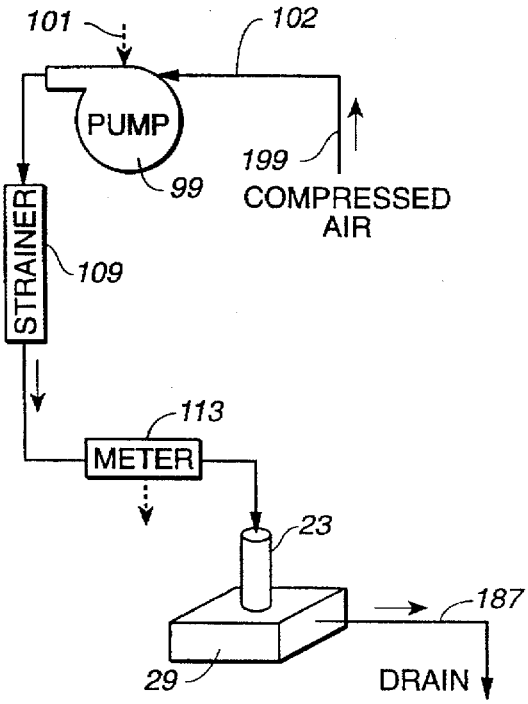
FIG. 8 shows portions of the filling machine of FIG. 1 that are cleaned by air.

As described above, the second channel supplying the nozzle assemble 23 may be cleaned without interrupting the bag filling operation by the first channel. The portions of the system of FIG. 1 that are used in a typical cleaning operation are illustrated in FIGS. 6, 7 and 8 to implement different aspects of the cleaning operation. An initial step of a preferred cleaning process, as shown in FIG. 6, rinse water is introduced to the tank 97 under pressure both at its main inlet and at a top spray head. The pump 99 then pumps water out of the tank 97 through the strainer 109, the flow meter 113, the nozzle assembly 23, with its valve opened, the receptacle 29 and then through the fluid path 187 to the drain. This step initially washes away most of the liquid product remaining in the delivery system from the previous filling of containers.

It is often desirable to precede the water rinse with an air purge to strip most of the product out of a majority of the delivery system being cleaned. This step is not specifically shown in the drawings but can be that which is described with respect to FIG. 8.

After rinsing with water, a next step of the preferred cleaning process, shown in FIG. 7, is to recirculate a cleaning solution through the same product delivery system. The specific cleaning solution utilized depends, of course, upon the type of product that is desired to be removed from the delivery system. Soft drink syrup, for example, adheres to the inside surfaces of pipes, hoses and other passages through which it has been moved, so a cleaning solution for soft drink syrups will include a compound that overcomes the bond of the syrup to such walls in order to remove it. The pump 99 circulates the cleaning solution from the tank 97, through the strainer 109, flow meter 113, valve assembly 23 and into the receptacle 29 and back to the cleaning solution tank 137 by a fluid path 193.

After the cleaning solution step of FIG. 7, a second water rinse, as described with respect to FIG. 6 is performed in order to remove the cleaning solution from the delivery system. A next step, illustrated in FIG. 8, is to use compressed air to blow out any remaining water from a major portion of the product delivery system. Compressed air is introduced through the path 199 and blows through the pump 99, strainer 109, flow meter 113, and the nozzle assembly 23, including all fluid paths in between, and then through the fluid path 187 to the drain.

Figure 9:
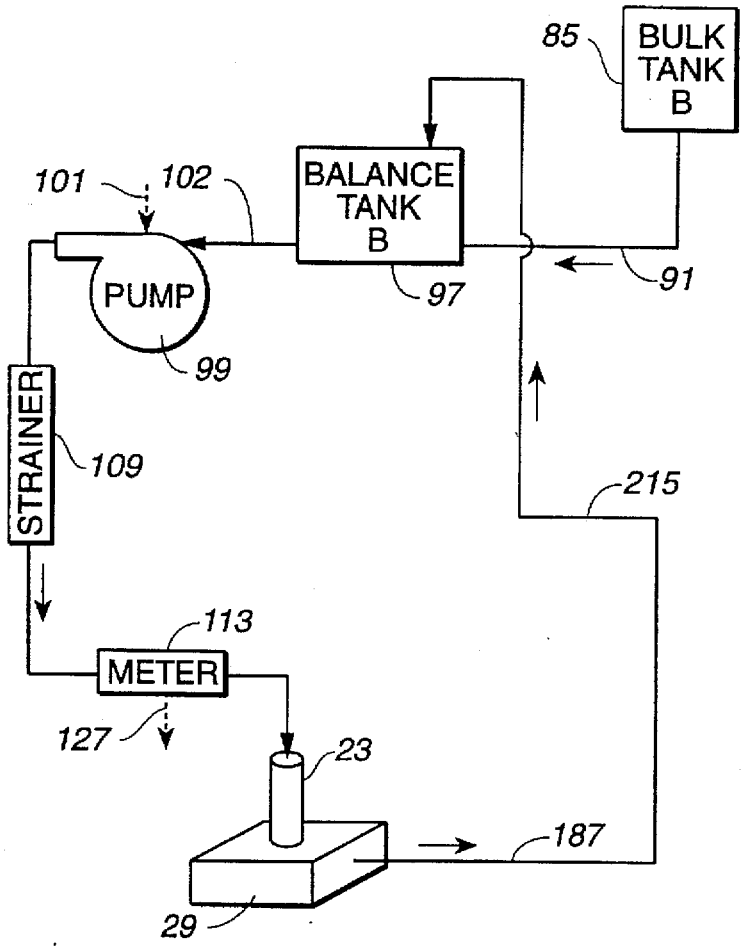
FIG. 9 shows portions of the filling machine of FIG. 1 that are used to recirculate fresh product in a portion of the machine after it has been cleaned.
Figure 10:
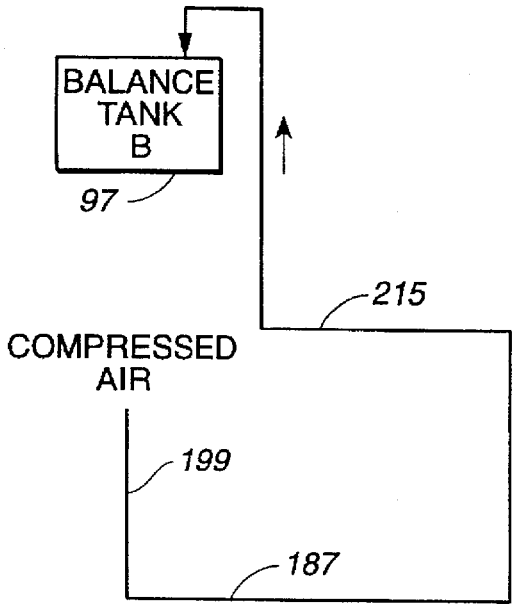
FIG. 10 shows the portions of the filling machine of FIG. 1 that are used to remove the fresh product from a portion of the recirculation path.

After the step shown in FIG. 8, the channel is ready to be loaded with fresh liquid product in preparation to fill bags with that product. In preparation for such loading, the product is recirculated through the system in the manner shown in FIG. 9. Product from the tank 85 is loaded into the tank 97 and then pumped by the pump 99 through the strainer 109, meter 113, nozzle assembly 23, and then through the receptacle 29, and fluid paths 187 and 215 back to the tank 97. This recirculation of fresh product occurs long enough to dissolve any small amounts of liquid or air bubbles that remain in the liquid delivery system, to be diluted with a large volume of product. The system is then ready to load containers with the fresh product. Before doing so, however, it is also desirable to remove product from the return paths 187 and 215 used in the product recirculation of FIG. 9. Therefore, as shown in FIG. 10, compressed air is used to push product in the return fluid paths 187 and 215 back into the balance tank 97. This prevents wasting that amount of product and is preparatory to cleaning the return path for subsequent use with a different product.

Figure 11:
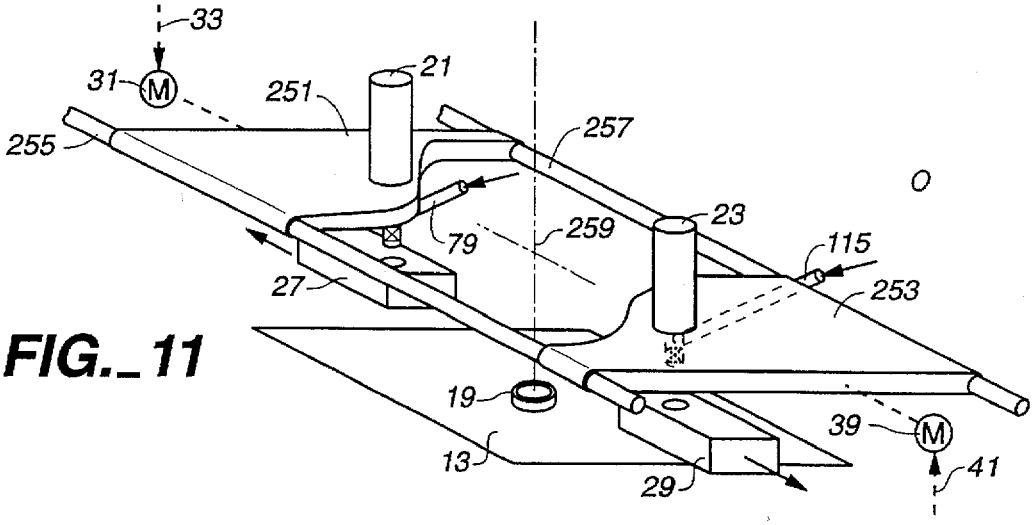
FIG. 11 illustrates one form of a mechanism for the filling station of the machine of FIG. 1.

A preferred filling station mechanical assembly is generally illustrated in FIG. 11. Plates 251 and 253 carry, respectively, the nozzle assemblies 21 and 23. These plates are slidable along parallel rods 255 and 257 from the position shown in FIG. 11 to a filling position indicated by a center line 259. Thus, when one of the nozzle assemblies is to be used to fill containers, it is moved from its position shown in FIG. 11 to the center fill position 259.

Figure 12:
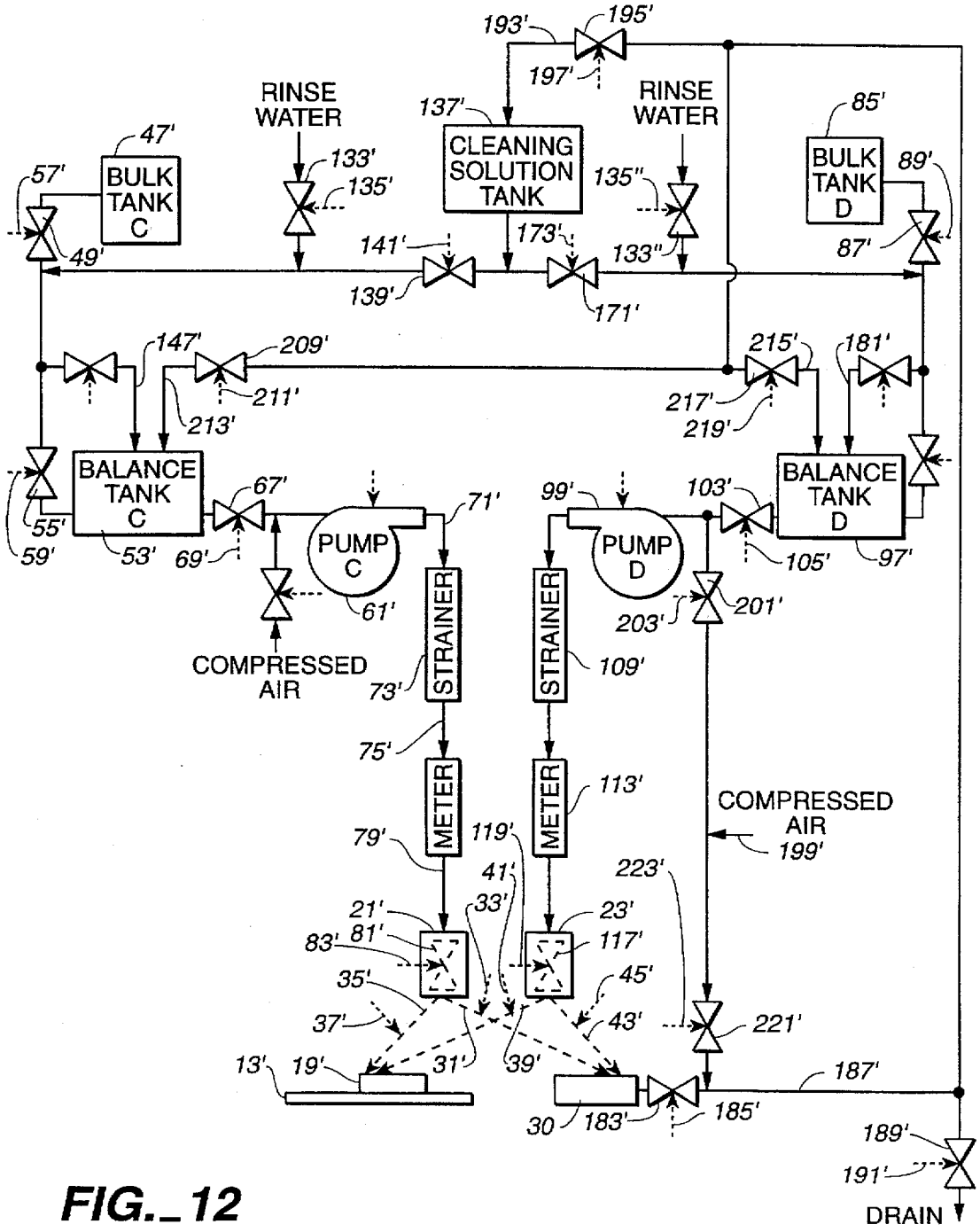
FIG. 12 schematically illustrates a second embodiment of a filling machine that utilizes the various aspects of the present invention.

Although it is preferred that one of the receptacles 27 and 29 be dedicated for exclusive use by a respective one of the nozzle assemblies 21 and 23, it is also possible to carry out most aspects of the present invention with the use of a single receptacle 30 as shown in a modified system of FIG. 12. The elements of the system of FIG. 12 are identified by the same reference numbers as corresponding elements of the system of FIGS. 1–10, but with a prime (') added. Each channel retains its separate product delivery system, including the bulk product supply tank, balance tank, pump, strainer, meter and nozzle assembly. However, since there is only a single receptacle 30 into which one of the nozzle assemblies 21' or 23' can be inserted at one time, there is a single cleaning system. That cleaning system is operated to clean the delivery system associated with the nozzle 21' when that nozzle is inserted into the receptacle 30. Similarly, when the nozzle 23' is inserted into the receptacle 30, that common cleaning system operates to clean the delivery system for that nozzle. Part of the fresh product recirculation system is also common to both channels since that can occur with only one channel at a time.

Figure 13A:
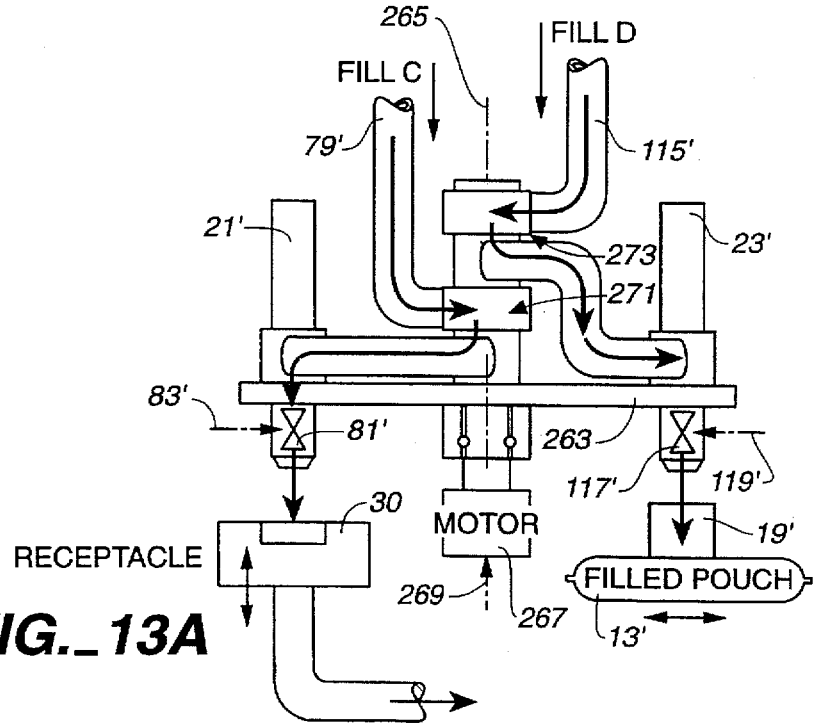
FIG. 13A illustrates an elevation view of an example mechanical assembly useful in the system of FIG. 12.
Figure 13B:
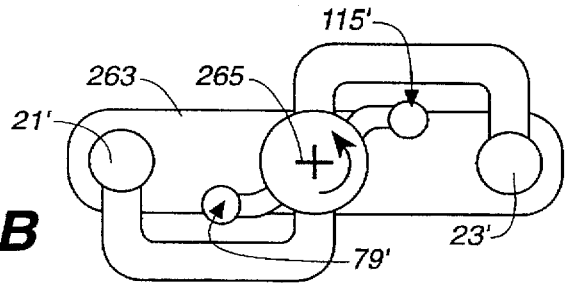
FIG. 13B is a plan view of the mechanism of FIG. 13A.

A mechanical fill head assembly suitable for implementing the system of FIG. 12 is shown in FIGS. 13A (elevation view) and 13B (plan view). The nozzle assemblies 21' and 23' are carried at opposite ends of an arm 263 that is rotated about an axis 265 by a motor 267 in response to a control signal 269. Rotary joints 271 and 273 connect the fluid paths 79' and 115', respectively, to the nozzle assemblies 21' and 23'. The arm 263 is rotated 180 degrees between two operable positions. In one of these positions, the nozzle assembly 21' is aligned with the receptacle 30 and the nozzle assembly 23' is in a position to fill bags with product, as shown in FIG. 13A. When the arm is rotated 180 degrees from that position, the nozzle assembly 21' is in a position to fill bags with product and the nozzle assembly 23' is in a position over the receptacle 30.

The cleaning system and techniques described herein also have applicability to a filling machine with a single nozzle and delivery system. Of course, such a machine must necessarily be taken out of the operation of filling containers during such cleaning, but the cleaning-in-place is improved.

The filling machine embodiments described herein are, as mentioned, particularly useful for soft drink liquid syrup. Of course, the system is also useful for other food liquids, such as milk. Non-food liquids can also be filled into bags. Although plastic bags have been described as the containers for shipment in use of the product, the filling systems described herein can be used with other types of containers such as rigid plastic or metal containers, corrugated paper containers, and the like.

Although the various aspects of the present invention have been described with respect to its preferred embodiments, it would be understood that the invention is entitled to protection within the full scope of the appended claims.

It is claimed:

1. Apparatus for filling containers with fluid product, comprising:

means for moving a plurality of said containers in succession through a filling station, at least two filling nozzles provided as part of the filling station, a source of fluid product, an individual means associated with each of said at least two filling nozzles for delivering fluid product thereto from said fluid product source, a source of cleaning fluid, means including at least one receptacle provided as part of the filling station for individually receiving at least one of said filling nozzles at a time to provide fluid communication therewith, means providing relative motion between said filling nozzles and both said at least one receptacle and a container positioned within the filling station for establishing fluid communication between individual ones of said nozzles and either said at least one receptacle or a container positioned in the filling station, means operable when one of said nozzles establishes fluid communication with a container positioned in the filling station for delivering fluid product from said fluid product source through a respective one of said individual product delivery means to its associated nozzle, thereby to fill said container with the fluid product, and means operable when one of said nozzles establishes fluid communication with said receptacle means for delivering cleaning fluid from said cleaning fluid source through a respective one of said individual product delivery means to its associated nozzle and into said receptacle means.

2. The filling apparatus of claim 1, wherein said relative motion providing means includes means for positioning one of said nozzles in fluid communication with said at least one receptacle and simultaneously positioning another of said nozzles in fluid communication with a plurality of containers in sequence as they are moved through the filling station by said container moving means, whereby said one nozzle is being cleaned while said another nozzle is filling containers.

3. The filling apparatus of claim 2, wherein said at least one receptacle includes at least two receptacles.

4. The filling apparatus of claim 1, wherein said at least one receptacle includes at least two receptacles.

5. The filling apparatus of claim 4 wherein there are an equal number of nozzles and receptacles.

6. The filling apparatus of claim 4, wherein there are exactly two nozzles and two receptacles.

7. The filling apparatus of claim 1 wherein said at least one receptacle means includes only one receptacle.

8. The filling apparatus of claim 7 wherein there are exactly two nozzles.

9. The filling apparatus according to any one of claims 1–4 wherein said cleaning fluid delivery means includes a holding tank of a cleaning liquid and means for recirculating said cleaning liquid from said tank, through a selected one of the individual product delivery means and its associated nozzle and said at least one receptacle, and then back to said holding tank.

10. The filling apparatus according to any one of claims 1–4 wherein said cleaning fluid delivery means includes means for passing either rinse water or air as the cleaning fluid through one of the individual product delivery means, its nozzle and said at least one receptacle and then from the at least one receptacle to a drain.

11. The filling apparatus according to any one of claims 1–4 which additionally comprises a holding tank of said fluid product and means operable after cleaning fluid has been passed through one of the individual product delivering means, its associated nozzle and said at least one receptacle for recirculating said fluid product through that same path and then through a return fluid path from the receptacle back to said holding tank.

12. The filling apparatus of claim 11 which additionally comprises means operable after fluid product has been recirculated for moving fluid product from the return fluid path back to said holding tank.

* * * * *